US011081040B2

(12) United States Patent
Chen et al.

(10) Patent No.: US 11,081,040 B2
(45) Date of Patent: Aug. 3, 2021

(54) PIXEL CIRCUIT, DISPLAY DEVICE AND DRIVING METHOD

(71) Applicants: Beijing BOE Display Technology Co., Ltd., Beijing (CN); BOE TECHNOLOGY GROUP CO., LTD., Beijing (CN)

(72) Inventors: Pengming Chen, Beijing (CN); Bin Zhang, Beijing (CN); Dianzheng Dong, Beijing (CN); Qiang Zhang, Beijing (CN); Guangxing Wang, Beijing (CN); Kan Zhang, Beijing (CN); Wenpeng Xu, Beijing (CN); Ziqiang Guo, Beijing (CN); Yongquan Lu, Beijing (CN)

(73) Assignees: Beijing BOE Display Technology Co., Ltd., Beijing (CN); BOE Technology Group Co., Ltd., Beijing (CN)

( * ) Notice: Subject to any disclaimer, the term of this patent is extended or adjusted under 35 U.S.C. 154(b) by 280 days.

(21) Appl. No.: 16/308,437

(22) PCT Filed: Apr. 19, 2018

(86) PCT No.: PCT/CN2018/083705
§ 371 (c)(1),
(2) Date: Dec. 7, 2018

(87) PCT Pub. No.: WO2018/233368
PCT Pub. Date: Dec. 27, 2018

(65) Prior Publication Data

US 2021/0012698 A1 Jan. 14, 2021

(30) Foreign Application Priority Data

Jun. 23, 2017 (CN) ..... 201710485858.5

(51) Int. Cl.
*G09G 3/20* (2006.01)
*G09G 3/36* (2006.01)

(52) U.S. Cl.
CPC ..... *G09G 3/2007* (2013.01); *G09G 3/3648* (2013.01); *G09G 2310/0202* (2013.01); *G09G 2310/0248* (2013.01); *G09G 2310/08* (2013.01)

(58) Field of Classification Search
None
See application file for complete search history.

(56) References Cited

U.S. PATENT DOCUMENTS 9,165,522 B2 10/2015 Ding
2009/0079683 A1 3/2009 Ding
(Continued)

FOREIGN PATENT DOCUMENTS

CN 101211040 A 7/2008
CN 101393726 A 3/2009
(Continued)

OTHER PUBLICATIONS

International Search Report and Written Opinion dated Jul. 13, 2018, for application No. PCT/CN2018/083705.

*Primary Examiner* — Matthew Yeung
(74) *Attorney, Agent, or Firm* — Arch & Lake LLP

(57) ABSTRACT

A pixel circuit includes a liquid crystal capacitor, a selection unit, a gray scale writing unit, and a reset unit. The selection unit is configured to determine whether to charge the liquid crystal capacitor according to a row control signal and a column control signal. The gray scale writing unit is configured to apply a gray scale voltage signal to the liquid crystal capacitor, when the selection unit determines to charge the liquid crystal capacitor, and an application duration of the gray scale voltage signal controls a gray scale level displayed by the liquid crystal capacitor. The reset unit
(Continued)

is configured to disconnect the gray scale writing unit and the liquid crystal capacitor to stop charging the liquid crystal capacitor upon receiving the reset signal, and reset the voltage of the liquid crystal capacitor to an initial state.

17 Claims, 10 Drawing Sheets

(56) References Cited

U.S. PATENT DOCUMENTS

| | | | | |
|---|---|---|---|---|
| 2011/0122106 | A1* | 5/2011 | Li | G09G 3/3648 345/205 |
| 2014/0267449 | A1* | 9/2014 | Hong | G09G 3/3696 345/690 |
| 2015/0262542 | A1 | 9/2015 | Lin et al. | |

FOREIGN PATENT DOCUMENTS

| | | | |
|---|---|---|---|
| CN | 101211040 | B | 7/2010 |
| CN | 104050940 | A | 9/2014 |
| CN | 106057154 | A | 10/2016 |
| CN | 107068107 | A | 8/2017 |
| CN | 106057154 | B | 5/2018 |
| KR | 20140078168 | A | 6/2014 |
| WO | WO-2018/018883 | A1 | 2/2018 |

* cited by examiner

| | | | | |
|---|---|---|---|---|
| L255 | L254 | L255 | ... | ... |
| L254 | L255 | L254 | ... | ... |
| L254 | L1 | L1 | ... | ... |
| L0 | L255 | L255 | ... | ... |
| ... | ... | ... | ... | ... |

PIXEL CIRCUIT, DISPLAY DEVICE AND DRIVING METHOD

CROSS-REFERENCE

The present disclosure is based on International Application No. PCT/CN2018/083705, filed on Apr. 19, 2018, which is based upon and claims priority to Chinese Patent Application No. 201710485858.5, filed on Jun. 23, 2017, titled as "PIXEL CIRCUIT, DISPLAY DEVICE AND DRIVING METHOD", and the entire contents thereof are incorporated herein by reference

TECHNICAL FIELD

The present disclosure relates to the field of liquid crystal display technology, and in particular to a pixel circuit, a display device, and a driving method.

BACKGROUND

For a liquid crystal panel, a conventional pixel structure is 1T1C (ie, 1 transistor+1 capacitor). To achieve different gray scales, an external Gamma circuit is required to give multiple fixed binding voltages, and then a fine voltage division is performed through a resistor string inside a source driver to obtain a 6-bit voltage value, and a digital-to-analog conversion is performed to charge a liquid crystal capacitor of a pixel circuit to generate a corresponding pixel voltage, thus the obtained logic circuit has large power consumption. Moreover, a gray scale voltage of a RGB sub-pixel is shared, and control cost of realizing an 8-bit voltage value is high. Generally, the source driver obtains the 6-bit voltage value by dividing voltage, and then an effect of 8 bit voltage value is obtained by a FRC pixel dithering algorithm of a timing controller. However, the FRC algorithm causes more defects and the debugging period is longer.

At present, the driving method for liquid crystal display is progressive scanning or interlaced scanning, and a source driving circuit writes the gray scale voltage to a pixel electrode row by row or interlaced. This driving method has an RC delay, and the delay is particularly obvious for the liquid crystal display with high resolution and ultra-high resolution, and has become one of the bottlenecks in designing ultra-high resolution liquid crystal display panels at the same time. As the resolution increases, there is also a problem of insufficient charging of the pixel electrode.

Therefore, there is still room for improvement in the technical solutions in the prior art.

It should be noted that the information disclosed in the Background section above is only for enhancing the understanding of the background of the present disclosure, and thus may include information that does not constitute prior art known to those of ordinary skill in the art.

SUMMARY

The present disclosure provides a pixel circuit, a display device, and a driving method.

Other features and advantages of the present disclosure will be apparent from the following detailed description, or be acquired in part by the practice of the present disclosure.

According to an aspect of the present disclosure, a pixel circuit is provided. The pixel circuit includes a liquid crystal capacitor having a first end and a second end. The pixel circuit includes a selection unit having the first end, the second end, and an output end. The first end of the selection unit is configured to receive a column control signal, the second end of the selection unit is configured to receive a row control signal, and the selection unit is configured to determine whether to charge the liquid crystal capacitor according to the row control signal and the column control signal. The pixel circuit includes a gray scale writing unit having the first end, the second end, and the output end. The first end of the gray scale writing unit is connected to the output end of the selection unit, and the second end of the gray scale writing unit is connected to a gray scale voltage signal, the output end of the gray scale writing unit is connected to the second end of the liquid crystal capacitor, and the gray scale writing unit is configured to apply the gray scale voltage signal to the liquid crystal capacitor, when the selection unit determines to charge the liquid crystal capacitor, and an application duration of the gray scale voltage signal controls a gray scale level displayed by the liquid crystal capacitor. The pixel circuit includes a reset unit having the first end, the second end, a third end, and a fourth end. The first end of the reset unit is connected to a reset signal end, the second end of the reset unit is connected to the output end of the selection unit, and the third end of the reset unit is connected to the output end of the gray scale writing unit, the fourth end of the reset unit is connected to a common voltage signal, and the reset unit is configured to disconnect the gray scale writing unit and the liquid crystal capacitor to stop charging the liquid crystal capacitor upon receiving the reset signal, and reset the voltage of the liquid crystal capacitor to an initial state.

In an exemplary arrangement of the present disclosure, the selection unit includes a first transistor and a second transistor. Each of the first and second transistors has the first end, the second end and a control end. The control end of the first transistor is connected to the column control signal, and the first end of the first transistor is connected to the row control signal, the second end of the first transistor is connected to the first end of the second transistor, and the control end of the second transistor is connected to the row control signal.

In an exemplary arrangement of the present disclosure, the gray scale writing unit includes a third transistor having a first end, a second end and a control end. The control end of the third transistor is connected to the second end of the second transistor, the first end of the third transistor is connected to the gray scale voltage signal, and the second end of the third transistor is connected to the second end of the liquid crystal capacitor.

In an exemplary arrangement of the present disclosure, the reset unit includes a fourth transistor, a fifth transistor, and a storage capacitor. Each of the fourth transistor and the fifth transistor has the first end, the second end and the control end. The storage capacitor has the first end and the second end. The control ends of the fourth transistor and the fifth transistor are both connected to the reset signal end. The first ends of the fourth transistor, the fifth transistor and the storage capacitor are all connected to the second end of the second transistor. The second end of the fourth transistor is connected to the common voltage signal. The second ends of the fifth transistor and the storage capacitor are connected to the first end of the liquid crystal capacitor. The second end of the liquid crystal capacitor is connected to the common voltage signal.

According to another aspect of the present disclosure, a display device is further provided. The display device includes a display panel having a plurality of above pixel circuits arranged in an array, and a timing controller. The timing controller is configured to determine a gray scale level that each of the pixel circuits in the display panel require to display according to information of a to-be-displayed image, and make a liquid crystal capacitor display a corresponding gray scale level by controlling a charging duration of the liquid crystal capacitor in the pixel circuit.

In an exemplary arrangement of the present disclosure, the timing controller includes a gray scale control unit configured to sequentially apply a gray scale voltage signal to the liquid crystal capacitors in all the pixel circuits corresponding to same gray scale levels according to the gray scale levels. The timing controller includes a charging control unit configured to simultaneously stop applying the gray scale voltage signal to the liquid crystal capacitors in all the pixel circuits in the display panel to control the charging duration of the liquid crystal capacitors in each of the pixel circuits.

In an exemplary arrangement of the present disclosure, the gray scale control unit is configured to determine location information of all the pixel circuits corresponding to a first gray scale level in the display panel. The gray scale control unit is configured to generate corresponding row control signals and column control signals according to the location information. The gray scale control unit is configured to apply the gray scale voltage signals to the liquid crystal capacitors in all the pixel circuits corresponding to the first gray scale level row by row according to the row control signals and the column control signals. The gray scale control unit is configured to apply the gray scale voltage signals to the liquid crystal capacitors in all the pixel circuits corresponding to a second gray scale level after applying the gray scale voltage signals to all the liquid crystal capacitors corresponding to the first gray scale levels, until the gray scale voltage signals is applied to the liquid crystal capacitors in all the pixel circuits corresponding to the first level of the last level gray scale level.

According to still another aspect of the present disclosure, a driving method for a pixel circuit is further provided. The driving method includes determining whether to charge a liquid crystal capacitor according to a row control signal and a column control signal. The driving method includes applying a gray scale voltage signal to the liquid crystal capacitor when determining to charge the liquid crystal capacitor; wherein a gray scale level of the liquid crystal capacitor is determined by an application duration of the gray scale voltage signal.

In an exemplary arrangement of the present disclosure, upon receiving a reset signal, charging of the liquid crystal capacitor is stopped, and voltage of the liquid crystal capacitor is reset to an initial state.

According to still another aspect of the present disclosure, a driving method for a display device is further provided. The driving method includes determining a gray scale level that each of pixel circuits in a display panel requires to display. The driving method includes making a liquid crystal capacitor display a corresponding gray scale level by controlling a charging duration of the liquid crystal capacitor in the pixel circuit.

In an exemplary arrangement of the present disclosure, making a liquid crystal capacitor display a corresponding gray scale level by controlling a charging duration of the liquid crystal capacitor in the pixel circuit includes applying sequentially a gray scale voltage signal to the liquid crystal capacitors in all the pixel circuits corresponding to same gray scale levels according to the gray scale levels. Such an operation further includes stopping simultaneously applying the gray scale voltage signal to the liquid crystal capacitors in all the pixel circuits in the display panel to control the charging duration of the liquid crystal capacitors in each of the pixel circuits.

In an exemplary arrangement of the present disclosure, applying sequentially a gray scale voltage signal to the liquid crystal capacitors in all the pixel circuits corresponding to same gray scale levels according to the gray scale levels includes determining location information of all the pixel circuits corresponding to a first gray scale level in the display panel. Such an operation further includes generating corresponding row control signals and column control signals according to the location information. Such an operation further includes applying the gray scale voltage signals to the liquid crystal capacitors in all the pixel circuits corresponding to the first gray scale level row by row according to the row control signals and the column control signals. Such an operation further includes applying the gray scale voltage signals to the liquid crystal capacitors in all the pixel circuits corresponding to a second gray scale level after applying the gray scale voltage signals to all the liquid crystal capacitors corresponding to the first gray scale levels, until the gray scale voltage signals is applied to the liquid crystal capacitors in all the pixel circuits corresponding to the first level of the last level gray scale level.

In an exemplary arrangement of the present disclosure, time of displaying a frame in the display panel is 1/(refresh rate*number of gray scale levels), wherein the number of gray scale levels is the number of all gray scale levels of the image, and the refresh rate is the number of times the display panel is refreshed in one second.

In an exemplary arrangement of the present disclosure, determining a gray scale level that each of pixel circuits in a display panel requires to display includes the grays scale level that each of the pixel circuits in the display panel require to display is determined according to information of a to-be-displayed image.

The above general description and the following detailed description are merely exemplary and explanatory and should not be construed as limiting of the disclosure.

BRIEF DESCRIPTION OF THE DRAWINGS

The accompanying drawings, which are incorporated in the specification and constitute a part of the specification, show exemplary arrangements of the present disclosure. The drawings along with the specification explain the principles of the present disclosure. It is apparent that the drawings in the following description show only some of the arrangements of the present disclosure, and other drawings may be obtained by those skilled in the art without departing from the drawings described herein.

DETAILED DESCRIPTION

Figure 1:
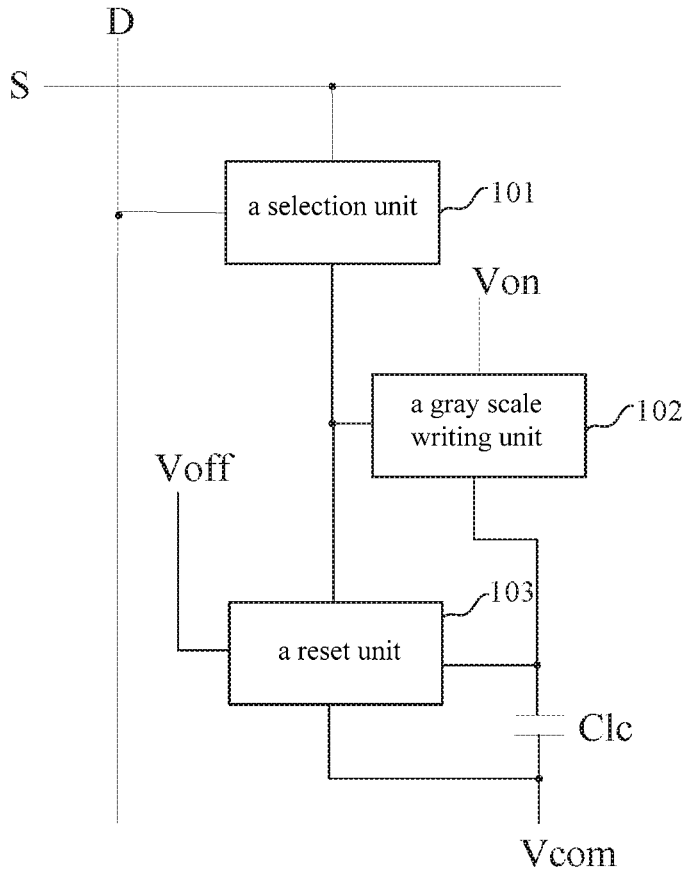
FIG. 1 shows a schematic structural diagram showing a pixel circuit provided in an arrangement of the present disclosure.

Example arrangements will now be described more fully with reference to the accompanying drawings. However, the arrangements can be implemented in a variety of forms and should not be construed as being limited to the examples set forth herein; rather, these arrangements are provided so that this disclosure will be more complete so as to convey the idea of the exemplary arrangements to those skilled in this art. The drawings are merely schematic representations of the present disclosure and are not necessarily drawn to scale. The same reference numerals in the drawings denote the same or similar parts, and the repeated description thereof will be omitted.

In addition, the described features, structures, or characteristics in one or more arrangements may be combined in any suitable manner. In the following description, numerous specific details are set forth to provide a full understanding of the arrangements of the present disclosure. However, one skilled in the art will appreciate that the technical solutions of the present disclosure can be practiced when one or more of the described specific details may be omitted or other methods, components, devices, steps, etc. may be employed. In other cases, well-known structures, methods, devices, implementations, materials, or operations are not shown in detail to avoid obscuring aspects of the present disclosure.

Some of the block diagrams shown in the figures are functional entities and do not necessarily correspond to physically or logically separate entities. These functional entities may be implemented in software, or implemented in one or more hardware modules or integrated circuits, or implemented in different networks and/or processor devices and/or microcontroller devices.

A transistor used in the arrangement of the present disclosure may be a thin film transistor or a field effect transistor or the like having the same characteristics. Since a source and a drain of the transistor are symmetrical, the source and the drain are indistinguishable. In the arrangement of the present disclosure, in order to distinguish the source and the drain of the transistor, the source and the drain are respectively referred to as a first end and a second end, a gate is referred to as a control end. In addition, according to the characteristics of the transistor, the transistor can be divided into an N-type transistor and a P-type transistor. When an N-type transistor is used, the first end is the source of the N-type transistor, the second end is the drain of the N-type transistor, and the source and drain are turned on when the gate input is at a high level. Conversely, when the P-type transistor is used, the source and the drain are turned on, when the gate input is at a low level. In the following arrangements, the description is taken the N-type transistor as an example. It is conceivable that the implementation of the P-type transistor can be easily conceived by those skilled in the art without paying creative work, and thus is also within the scope of protection of the arrangements of the present disclosure.

FIG. 1 shows a schematic structural diagram showing a pixel circuit according to an arrangement of the present disclosure. As shown in FIG. 1, a pixel circuit 100 includes a liquid crystal capacitor the liquid crystal capacitor Clc, a selection unit 101, a gray scale writing unit 102, and a reset unit 103.

In the present arrangement, the liquid crystal capacitor Clc has two ends, which are a first end and a second end, respectively. The selection unit 101 has the first end, the second end and an output end. The first end of the selection unit 101 is configured to receive a column control signal, and the second end of the selection unit 101 is configured to receive a row control signal, wherein the row control signal is a scan signal provided by a scan line S, and the column control signal is a data signal provided by a data line D. The selection unit 101 is configured to determine whether to charge the liquid crystal capacitor Clc according to the row control signal and the column control signal.

In the present arrangement, the gray scale writing unit 102 has the first end, the second end and the output end. The first end of the gray scale writing unit 102 is connected to the output end of the selection unit 101. The second end of the gray scale writing unit 102 is connected to a gray scale voltage signal Von. The output end of the gray scale writing unit 102 is connected to the first end of the liquid crystal capacitor Clc. The gray scale writing unit 102 is configured to apply the gray scale voltage signal Von to the liquid crystal capacitor Clc, when the selection unit 101 determines to charge the liquid crystal capacitor Clc, and a gray scale level displayed by the liquid crystal capacitor Clc is controlled by an application duration of the gray scale voltage signal.

In the present arrangement, the reset unit 103 has a first end, a second end, a third end, and a fourth end. The first end of the reset unit 103 is connected to a reset signal end Voff. The second end of the reset unit 103 is connected to the output end of the selection unit 101. The third end of the reset unit 103 is connected to the output end of the gray scale writing unit 102. The fourth end of the reset unit 103 is connected to the common voltage signal Vcom. The reset unit 103 is configured to, upon receiving the reset signal end Voff, disconnect the gray scale writing unit 102 and the liquid crystal capacitor Clc to stop charging the liquid crystal capacitor Clc and reset the voltage of the liquid crystal capacitor Clc to an initial state. The reset unit 103 is configured to start the next frame display by the reset signal after completing the display of all the gray scale levels of one frame.

Figure 2:
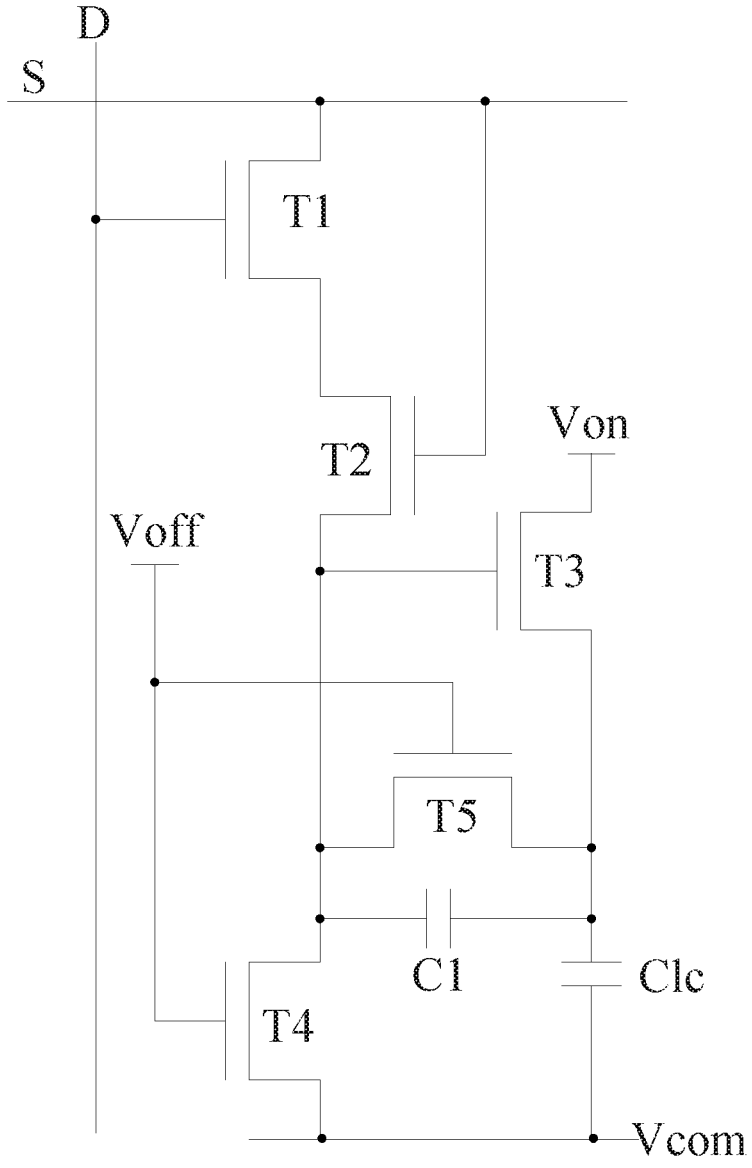
FIG. 2 shows a circuit diagram corresponding to a pixel circuit in FIG. 1 in an arrangement of the present disclosure.

FIG. 2 shows a circuit diagram corresponding to a pixel circuit in FIG. 1 in an arrangement of the present disclosure. As shown in FIG. 2, the pixel circuit includes transistors (T1, T2, T3, T4, T5), a liquid crystal capacitor Clc, and a storage capacitor C1, In addition, the pixel circuit includes three electrode signals, that is the gray scale voltage signal Von, the reset signal end Voff, and the common voltage signal Vcom, and two control lines of the scan line S and the data line D.

As shown in FIGS. 1 and 2, the selection unit 101 includes: a first transistor T1 and a second transistor T2, each having the first end, the second end, and the control end, wherein the control end of the first transistor T1 is connected to the column control signal, the first end of the transistor T1 is connected to the row control signal, the second end of the first transistor T1 is connected to the first end of the second transistor T2, and the control end of the second transistor T2 is connected to the row control signal. In the circuit of the arrangement, N-type transistors are taken as examples of all the transistors are, when the row control signal is at a high level, the second transistor T2 is turned on, and when the corresponding column control signal is at a high level, the first transistor T1 is also turned on.

The gray scale writing unit 102 includes a third transistor T3 having a first end, a second end, and a control end. The control end of the third transistor T3 is connected to the second end of the second transistor T2. The first end of the third transistor T3 is connected to the gray scale voltage signal Von. The second end of the third transistor T3 is connected to the second end of the liquid crystal capacitor Clc. The gray scale voltage signal Von provides a positive/negative voltage to a pixel electrode, and the value can be 2Vcom or 0. When the first transistor T1 and the second transistor T2 are turned on, and a gate of the third transistor T3 is at a high level, in this way that the third transistor T3 is also turned on, and the liquid crystal capacitor Clc is charged.

The reset unit 103 includes a fourth transistor T4, a fifth transistor T5, and a storage capacitor C1. The fourth transistor T4 and the fifth transistor T5 both have first ends, second ends, and control ends. The storage capacitor C1 has a first end and a second end. The control ends of the fourth transistor T4 and the fifth transistor T5 are connected to the reset signal end Voff. The first ends of the fourth transistor T4, the fifth transistor T5 and the storage capacitor C1 are connected to the second end of the second transistor T2. The second end of the fourth transistor T4 is connected to the common voltage signal Vcom. The second ends of the fifth transistor T5 and the storage capacitor C1 are connected to the first end of the liquid crystal capacitor Clc. The second end of the liquid crystal capacitor Clc is connected to the common voltage signal Vcom. The reset signal end Voff is at a low level, and the fourth transistor T4 and the fifth transistor T5 are turned off, therefore, when the first transistor T1 and the second transistor T2 are turned on, the storage capacitor C1 is also charged until all the gray scale levels are displayed. The reset signal end Voff is at a high level, the fourth transistor T4 and the fifth transistor T5 are turned on, in this way that the storage capacitor C1 and the liquid crystal capacitor Clc are discharged, and the next frame display is started.

In the present arrangement, by improving the circuit, the scan line is rapidly progressive scanning at the beginning of each frame, when the L255 gray scale is needed to display during the scanning of the current row, the first transistor T1 of a pixel structure displaying the L255 gray scale is turned on by the data signal output from the data line. The storage capacitor C1 is charged and the third transistor T3 is simultaneously fully turned on. The liquid crystal capacitor Clc is charged by the Von voltage for display. After Tcon waits for time t, all the first transistors T1 of the pixel structures that require to display the L254 gray scale are turned on by the row control signal and the column control signal, so that the liquid crystal capacitor Clc is charged by the Von voltage for display. The first transistor T1 of each gray scale pixel structure is turned on one by one in a gray scale decreasing manner, in this way, the corresponding the liquid crystal capacitor Clc is charged by the voltage Von for display. After all the first transistors T1 of L1 gray scale pixel structures have been turned on, all T4 and T5 are turned on by pulling Voff high after waiting for time 2*t*, in this way that the storage capacitor C1 and the liquid crystal capacitor Clc are discharged for displaying the next frame.

On the basis of the pixel circuit provided in the present arrangement, the progressive charging driving method in the related art is changed, instead of sequential charging based on a fixed position, the gray scale is charged by the same voltage one by one according to the control signal timing, and the gray scale brightness is determined by the holding time of pixel electrode voltage of the liquid crystal capacitor Clc. By controlling the increasing of the charging time of the pixel electrode, charging efficiency is increased. The design of a resistor string in a source driving circuit is eliminated, the power consumption can be greatly reduced. The γ voltage correction can be separately performed on the RGB without being adjusted by ACC on a common voltage basis, thus saving IC cost and making it easier to implement 8 bit and above control.

Figure 3:
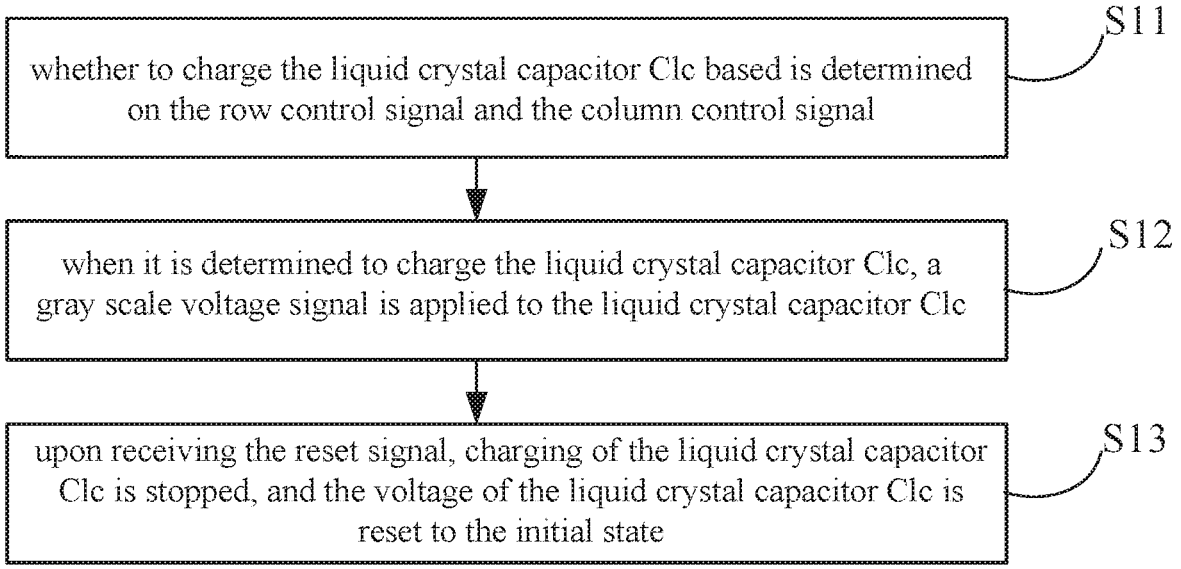
FIG. 3 shows a flow chart of a driving method for a pixel circuit in an arrangement of the present disclosure.

FIG. 3 shows a flow chart of a driving method for a pixel circuit in an arrangement of the present disclosure.

In block S11, whether to charge the liquid crystal capacitor Clc based is determined on the row control signal and the column control signal.

In block 512, when it is determined to charge the liquid crystal capacitor Clc, a gray scale voltage signal is applied to the liquid crystal capacitor Clc. Wherein the gray scale level of the liquid crystal capacitor in the arrangement is determined by application duration of the gray scale level signal.

In block S13, upon receiving the reset signal, charging of the liquid crystal capacitor Clc is stopped, and the voltage of the liquid crystal capacitor Clc is reset to the initial state. That is to say, when all the gray scale levels of the pixels are displayed, the voltage charged in the liquid crystal capacitor Clc is released by the reset signal, and the display of the next frame is started.

According to the driving method provided in the present arrangement, regardless of resolution of the display panel, pixel charging time is 1/(refresh rate*the number of gray scale levels). The refresh rate is usually 60-75 HZ. Generally, and the gray scale of the 8 bit display is $2^8$=256. If the refresh rate of the display panel is 60 Hz, the resolution is 1920*1080, and the charging time of the display panel is 1/(60*256)=65.10 us. Therefore, the pixel circuit and the driving method thereof provided by the arrangement are particularly suitable for the display panel with high resolution and ultra-high resolution.

Figure 4:
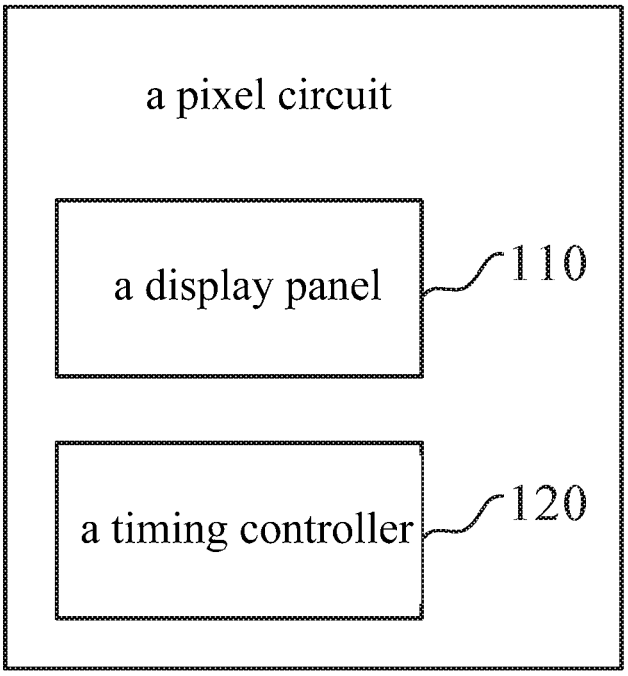
FIG. 4 shows a schematic structural diagram showing a display device provided in another arrangement of the present disclosure.

FIG. 4 shows a schematic structural diagram showing a display device provided in another arrangement of the present disclosure. The display device 100 includes a display panel 110 and a timing controller 120. The display panel 110 has a plurality of the above pixel circuits arranged in an array. The timing controller 120 is configured to determine the gray scale level that each of the pixel circuits in the display panel require to display according to information of a to-be-displayed image, and make the liquid crystal capacitor display a corresponding gray scale level by controlling the charging duration of the liquid crystal capacitor in the pixel circuit. In addition, the timing controller 120 also controls the row control signal, the column control signal, the gray scale voltage signal, and the reset signal supplied to the display panel 110 through timing control signals.

Figure 5:
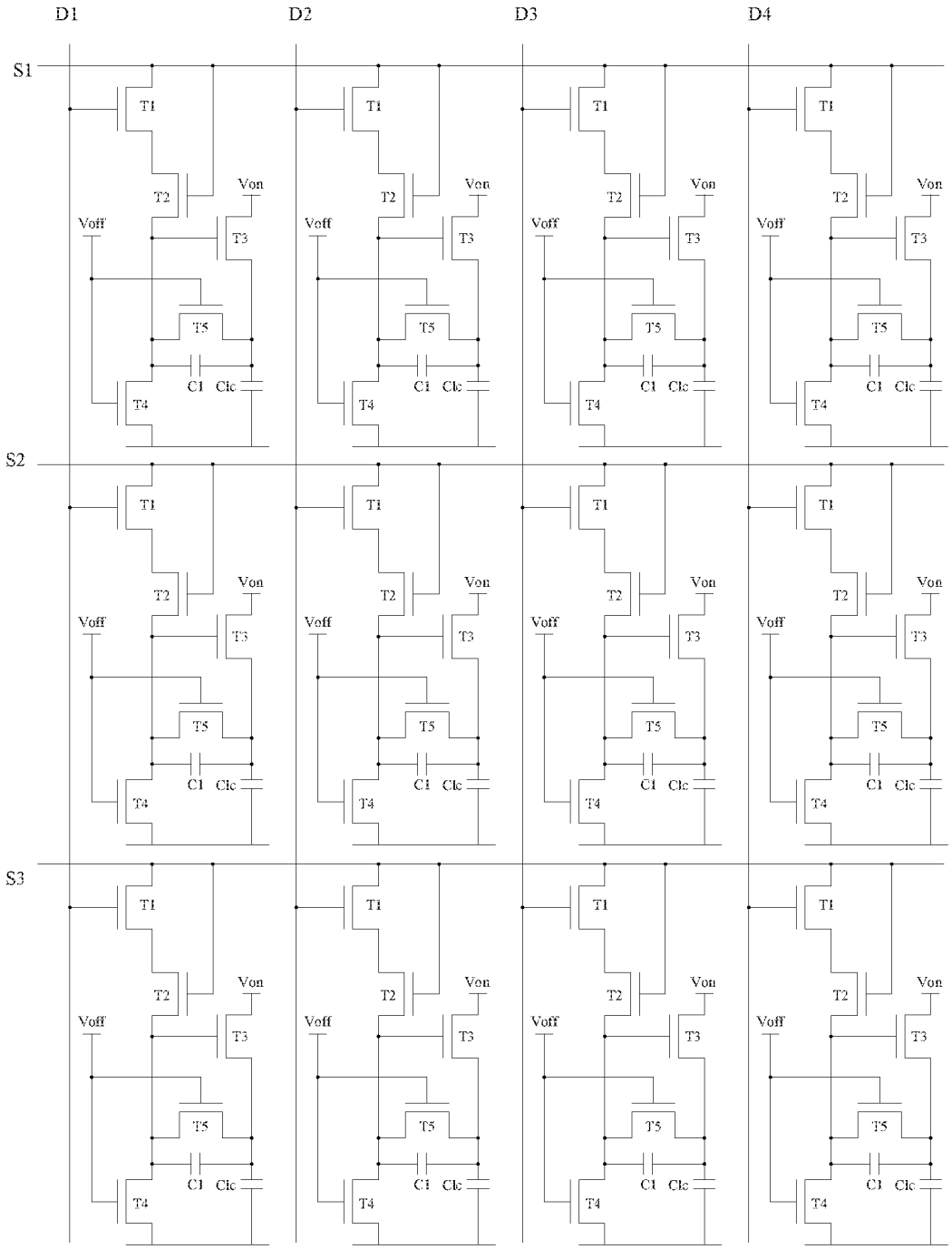
FIG. 5 shows a schematic diagram showing an array structure of a display panel in another arrangement of the present disclosure.

In the display panel 110, a plurality of (n) scan lines S and a plurality of (m) data lines D are usually included, and a plurality of (m*n) pixel circuits shown in FIG. 2 are also included, and FIG. 5 shows a schematic diagram showing an array structure of a display panel in another arrangement of the present disclosure. As shown in FIG. 5, three scan lines (S1, S2, S3) and four data lines (D1, D2, D3, D4) are included in the array structure. The array structure is described by taking n=3 and m=4 as an example, those skilled in the art can understand that the display panel according to the arrangement of the present disclosure may include more other numbers of scan lines and data lines, which is not limited by the present disclosure It should be noted that the reset signal ends Voff in FIG. 5 are all controlled and provided by the timing controller 130.

Figure 6:
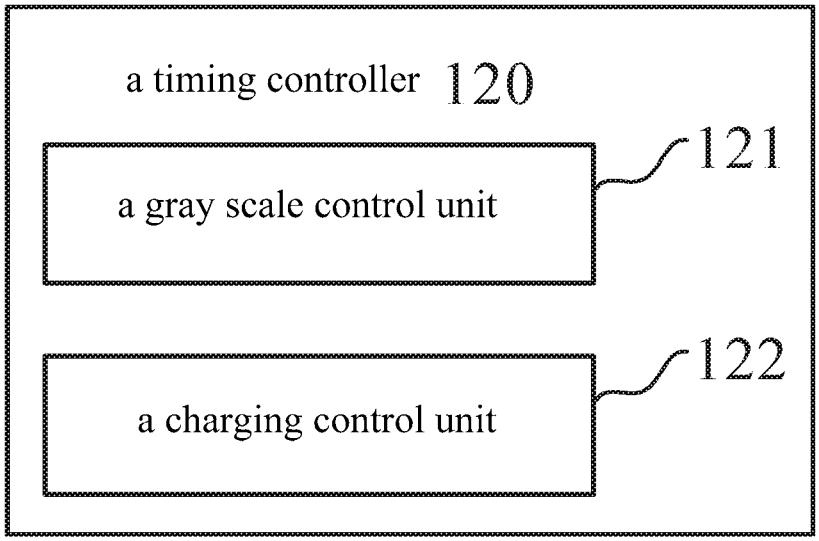
FIG. 6 shows a schematic diagram showing a processor in another arrangement of the present disclosure.

FIG. 6 shows a schematic diagram of a processor in another arrangement of the present disclosure. As shown in FIG. 6, the timing controller 120 includes a gray scale control unit 121 and a charging control unit 122. The gray scale control unit 121 is configured to sequentially apply gray scale voltage signals to the liquid crystal capacitors in all the pixel circuits corresponding to the same gray scale according to the gray scale levels. The charging control unit 122 is configured to simultaneously stop applying gray scale voltage signals on the liquid crystal capacitors of all the pixel circuits in the display panel to control the charging duration of the liquid crystal capacitors in each pixel circuit.

In addition, the gray scale control unit 121 in the present arrangement is specifically configured to determine location information in the display panel of all pixel circuits corresponding to a first gray scale level; and is further configured to generate corresponding row control signals and column control signals according to the location information; and is further configured to apply the gray scale voltage signals to the liquid crystal capacitors in all the pixel circuits corresponding to the first gray scale level row by row according to the row control signals and the column control signals; and is further configured to apply the gray scale voltage signals to the liquid crystal capacitors in all the pixel circuits corresponding to a second gray scale level after applying the gray scale voltage signals to all the liquid crystal capacitors corresponding to the first gray scale levels, until the gray scale voltage signals is applied to the liquid crystal capacitors in all the pixel circuits corresponding to the first level of the last level gray scale level.

Taking the array structure shown in FIG. 5 as an example, the pixel circuit at the intersection of the scan line S1 and the data line D1 can be represented by coordinates (S1, D1) (for the entire display panel, each pixel circuit which is visible to the naked eye is just a bright dot, so it may also be referred to as a pixel point), the location of the pixel point required to display is determined by a position determining module 1211, and then the liquid crystal capacitor is charged to realize gray scale display of the pixel point.

Figure 7:
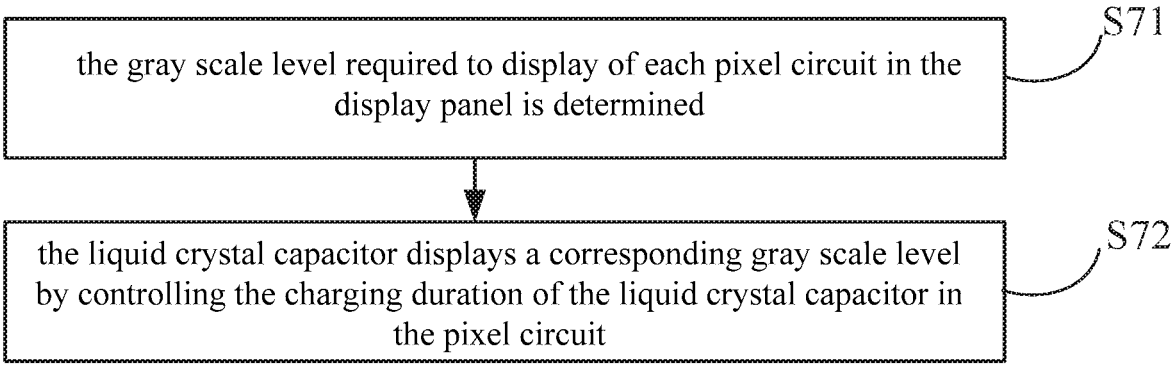
FIG. 7 shows a flow chart of a driving method for a display device according to still another arrangement of the present disclosure.

Based on the above, FIG. 7 shows a flow chart of a driving method for a display device according to still another arrangement of the present disclosure.

In block S71, the gray scale level required to display of each pixel circuit in the display panel is determined. Specifically, in the present arrangement, the gray scale level required to display of each pixel circuit in the display panel is determined according to the information of the to-be-displayed image of the display device.

In block S72, the liquid crystal capacitor displays a corresponding gray scale level by controlling the charging duration of the liquid crystal capacitor in the pixel circuit.

In the arrangement, in the block of controlling the charging duration of the liquid crystal capacitor in the pixel circuit, first, according to the gray scale level, the gray scale voltage signal is applied sequentially to the liquid crystal capacitors in all the pixel circuits corresponding to the same gray scale level, and the gray scale voltage signal is stopped simultaneously being applied to the liquid crystal capacitors in all the pixel circuits in the display panel to control the charging duration of the liquid crystal capacitors in each pixel circuit.

Further, in the arrangement, in the block of sequentially applying the gray scale voltage signal to the liquid crystal capacitors in all the pixel circuits corresponding to the same gray scale level according to the gray scale level, first, location information in the display panel of all pixel circuits corresponding to a first gray scale level is determined. Secondly, corresponding row control signals and column control signals are generated according to the location information. Then, the gray scale voltage signals are applied to the liquid crystal capacitors in all the pixel circuits corresponding to the first gray scale level row by row according to the row control signals and the column control signals. Finally, the gray scale voltage signals are applied to the liquid crystal capacitors in all the pixel circuits corresponding to a second gray scale level after applying the gray scale voltage signals to all the liquid crystal capacitors corresponding to the first gray scale levels, until the gray scale voltage signals is applied to the liquid crystal capacitors in all the pixel circuits corresponding to the first level of the last level gray scale level.

Therefore, in a display period of one frame, all the gray scale levels may be displayed one by one in the gray scale level increasing or decreasing manner. The same gray scale voltage signal is charged to the plurality of pixel circuits displaying the same gray scale level, and the gray scale level of the corresponding pixel circuit is determined by controlling the duration of applying the gray scale voltage signal to the liquid crystal capacitor Clc.

Taking the gray decreasing progressively as an example, the controlling the duration of applying the gray scale voltage signal to the liquid crystal capacitor includes: the gray scale voltage signal applied to the liquid crystal capacitor corresponding to the maximum gray scale level is determined by both the row control signal and the column control signal; after all the pixel circuits of the maximum gray scale level in the display panel are all displayed, the next gray scale is displayed by means of the gray scale decreasing progressively, until a gray scale voltage signal is applied to the liquid crystal capacitor corresponding to the previous gray scale level of the minimum gray scale level. After all gray scale levels are displayed in one frame, charging of the liquid crystal capacitor is stopped by applying a reset signal.

It should be noted that when the same gray scale level is displayed in the display panel, scanning the next row may be performed without waiting for the current row liquid crystal capacitor Clc to be charged to the gray scale voltage signal. Thus, regardless of the resolution of the display panel, the time of displaying one frame of the display panel is 1/(refresh rate*the number of gray scale levels). The number of gray scale levels is the number of all gray scale levels of the image, and the refresh rate is the number of times the display panel 110 is refreshed in one second, so that the charging time of the pixel electrode can be effectively increased and the charging efficiency is increased.

Figures 8, 9:
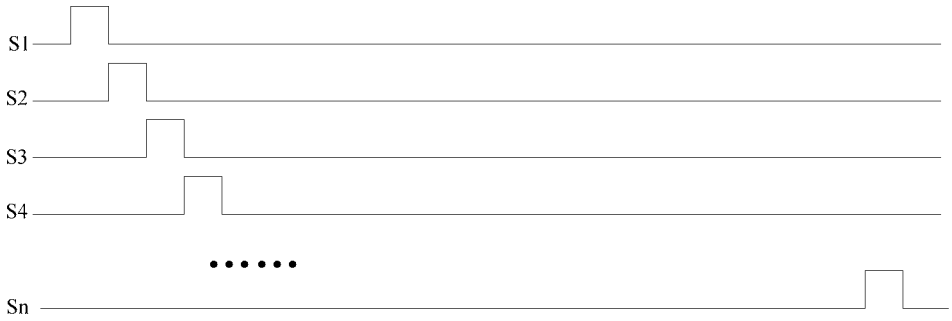
FIG. 8 shows a timing waveform diagram showing a row control signal output from a timing controller Tcon in still another arrangement of the present disclosure.
FIG. 9 shows a schematic diagram showing gray scale voltages of the image required to display.

FIG. 8 shows a timing waveform diagram of a row control signal output by the timing controller Tcon in still another arrangement of the present disclosure. The scan lines S1, S2, . . . , Sn are turned on row by row, as shown in FIG. 8, and the row control signals output by S1, S2, . . . , Sn become valid high levels row by row.

Generally, the display panel is divided into a normally black mode and a normally white mode. ADS (a type of IPS (In-Plane Switching) display mode) display mode and TN (Twisted Nematic) display mode are respectively taken as examples and described referring the pixel circuit array shown in FIG. 1 and FIG. 2 and display principle of the pixel circuit.

According to the above, taking ADS display mode as an example, FIG. 9 shows a schematic diagram of gray scale voltages of the image required to display. A part of the to-be-displayed image shown in FIG. 9 (ie, 12 pixel circuits (3 rows, 4 columns) are selected from the upper left corner) is selected to explain the display principle. For the to-be-displayed image, the maximum gray scale is L255, and the minimum gray scale level is L0.

In the ADS display mode, at the beginning of the first frame, Voff is set at a low level to turn off T4 and T5, and Von is 2Vcom or 0 (to provide positive/negative voltage to the pixel electrode).

For display L255 gray scale pixel points, the row control signals progressively scanns from the first row to the last row, and the time when the row control signal starts scanning is recorded as ts; if the pixel corresponding to the current row is required to display the L255 gray scale, the data line D signal corresponding to the column is set at a high level. At this time, the first transistor T1 and the second transistor T2 are simultaneously turned on, the storage capacitor C1 is charged, the gate of the third transistor T3 is set at a high level, the third transistor T3 is turned on, and the liquid crystal capacitor Clc is charged. Due to the presence of the storage capacitor C1, the gate voltage of the third transistor T3 will be gradually increased until the third transistor T3 is fully turned on. All row control signals can continue to scan the next row without waiting for the pixel electrode of the liquid crystal capacitor Clc to be charged to Von, increasing the scan rate. When the row control signal is scanned to the last row, the pixel electrodes of all the pixel points that are required to display the L255 gray scale are charged to the Von voltage, and this moment is recorded as t255.

Figure 10:
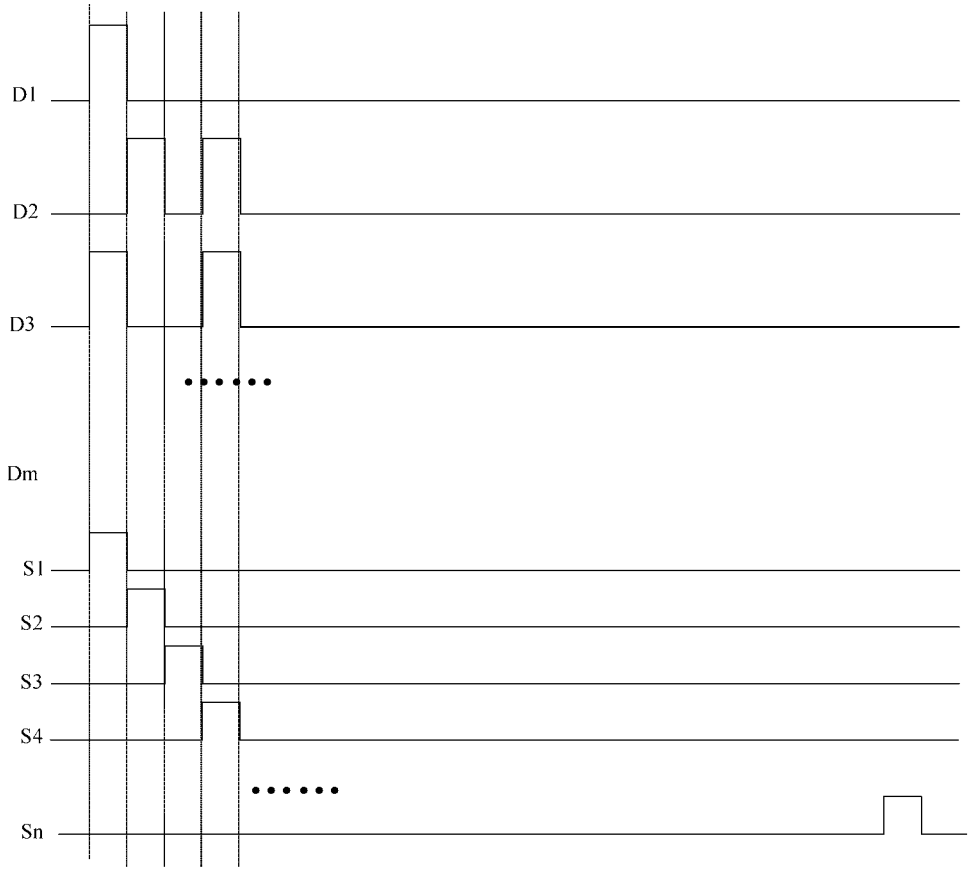
FIG. 10 shows a timing chart of a control signal of a gray scale voltage corresponding to L255 display at the time of the first progressive scanning of the scan line.

FIG. 10 shows a timing chart of a control signal of a gray scale voltage corresponding to L255 display at the time of the first progressive scanning of the scan line. As shown in FIG. 10, when the scan line is progressively scanning for the first time, the row control signal output by S1 is at a high level. Two pixel points of the L255 gray scale are required to display at the first row in gray scale of the to-be-displayed image shown in FIG. 9, that is, the (1, 1) and (1, 3) pixel points, therefore, the column control signals output by the corresponding data lines D1 and D3 are valid high levels. The row control signal output by the S2 is at a high level, a pixel point of the L255 gray scale is required to display at the second row in gray scale of the to-be-displayed image shown in FIG. 9, that is, (2, 2) pixel point, therefore, the column control signal output by the corresponding data line D2 is a valid high level. The row control signal output by the S3 is at a high level, no pixel point of the L255 gray scale is required to display at the second row in gray scale of the to-be-displayed image shown in FIG. 9, therefore, the column control signals output by the corresponding data lines D1, D2, and D3 are all low levels. The row control signal output by the S4 is at a high level, two pixel points of the L255 gray scale are required to display at the second row in gray scale of the to-be-displayed image shown in FIG. 9, that is, (4, 2) and (4, 3) pixel points, therefore, the column control signals output by the corresponding data lines D2 and D3 are valid high levels For display L254 gray scale pixel points, after the pixel electrodes of all the pixel points that are required to display the L255 gray scale in the display panel are charged to the Von voltage, Tcon waits for time tw. Then the row control signal starts the next scan and are progressively scanning from the first row to the last row; if the pixel corresponding to the current row is required to display the L254 gray scale, the data line D signal corresponding to the column is set at a high level. At this time, the first transistor T1 and the second transistor T2 are simultaneously turned on, the storage capacitor C1 is charged, the gate of the third transistor T3 is set at a high level, the third transistor T3 is turned on, and the liquid crystal capacitor Clc is charged. Due to the presence of the storage capacitor C1, the gate voltage of the third transistor T3 will be gradually increased until the third transistor T3 is fully turned on. All row control signals can continue to scan the next row without waiting for the pixel electrode of the liquid crystal capacitor Clc to be charged to Von, increasing the scan rate. When the row control signal is scanned to the last row, the pixel electrodes of all the pixel points that are required to display the L254 gray scale are charged to the Von voltage, and the time is recorded as t254.

Figure 11:
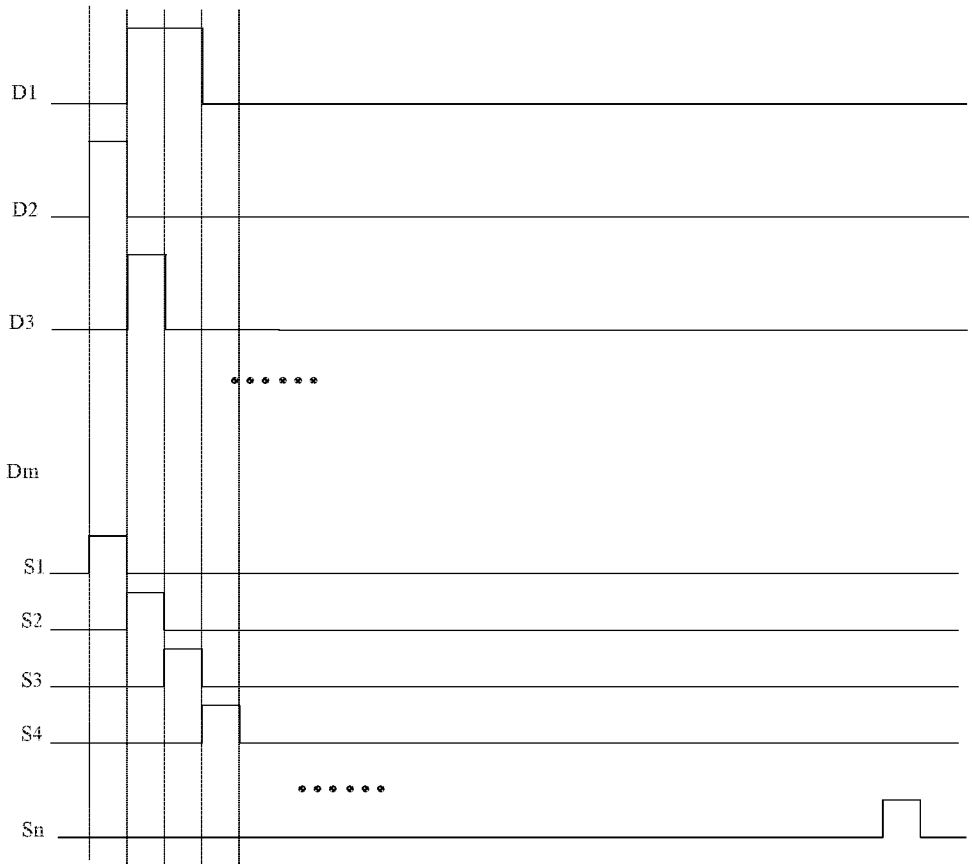
FIG. 11 shows a timing chart of a control signal of a gray scale voltage corresponding to L254 display at the time of the second progressive scanning of the scan line.

FIG. 11 shows a timing chart of a control signal of a gray scale voltage corresponding to L254 display at the time of the second progressive scanning of the scan line. As shown in FIG. 11, when the scan line is progressively scanning for the second time, the row control signal output by S1 is at a high level. A pixel point of the L254 gray scale is required to display at the first row in gray scale of the to-be-displayed image shown in FIG. 9, that is, the (1, 2) pixel point, therefore, the column control signal output by the corresponding data lines D2 is the valid high level; the row control signal output by the S2 is at a high level, two pixel points of the L254 gray scale are required to display at the second row in gray scale of the to-be-displayed image shown in FIG. 9, that is, (2, 1) and (2, 3) pixel points, therefore, the column control signals output by the corresponding data lines D1 and D3 are valid high levels; the row control signal output by the S3 is at a high level, a pixel point of the L254 gray scale is required to display at the third row in gray scale of the to-be-displayed image shown in FIG. 9, that is, (3, 1) pixel point, therefore, the column control signals output by the corresponding data line D1 is the valid high level; the row control signal output by the S4 is at a high level, no pixel point of the L255 gray scale is required to display at the fourth row in gray scale of the to-be-displayed image shown in FIG. 9, therefore, the column control signals output by the corresponding data lines D1, D2 and D3 are all low levels.

It should be noted that the times t255 and t254 in the present arrangement, and the time t253 . . . below are only used to distinguish the charging moments of different gray scale levels, and the waiting time tw is used to adjust the display duration of each gray scale level.

For display L253 gray scale pixel points, after the pixel electrodes of all the pixel points that are required to display the L254 gray scale in the display panel are charged to the Von voltage, Tcon waits for time tw. Then the row control signal starts the next scan and are progressively scanning from the first row to the last row; if the pixel corresponding to the current row is required to display the L253 gray scale, the data line D signal corresponding to the column is set at a high level. At this time, the first transistor T1 and the second transistor T2 are simultaneously turned on, the storage capacitor C1 is charged, the gate of the third transistor T3 is set at a high level, the third transistor T3 is turned on, and the liquid crystal capacitor Clc is charged. Due to the presence of the storage capacitor C1, the gate voltage of T3 will be gradually increased until the third transistor T3 is fully turned on. All row control signals can continue to scan the next row without waiting for the pixel electrode of the liquid crystal capacitor Clc to be charged to Von, increasing the scan rate. When the row control signal is scanned to the last row, the pixel electrodes of all the pixel points that are required to display the L253 gray scale are charged to the Von voltage, and the time is recorded as t253.

By analogy, after the pixel electrodes of all the pixel points that are required to display the L(N+1) (N>1) gray scale in the display panel are charged to the Von voltage, the timing controller Tcon waits for time tw. Then the row control signal starts the next scan, so that the pixel electrodes of all the pixel points that are required to display the L (N) gray scale are charged to the Von voltage.

For display L1 gray scale pixel points, after the pixel electrodes of all the pixel points that are required to display the L1 gray scale in the display panel are charged to the Von voltage, Tcon waits for time tw. Then the row control signal starts the next scan and are progressively scanning from the first row to the last row; if the pixel corresponding to the current row is required to display the L1 gray scale, the data line D signal corresponding to the column is set at a high level. At this time, the first transistor T1 and the second transistor T2 are simultaneously turned on, the storage capacitor C1 is charged, the gate of the third transistor T3 is set at a high level, T3 is turned on, and the liquid crystal capacitor Clc is charged. Due to the presence of the storage capacitor C, the gate voltage of the third transistor T3 will be gradually increased to the third transistor T3 to the maximum. All row control signals can continue to scan the next row without waiting for the pixel electrode of the liquid crystal capacitor Clc to be charged to Von, increasing the scan rate. When the last row is scanned by the row control signal, the pixel electrodes of all the pixel points that are required to display the L1 gray scale are charged to the Von voltage, and this moment is recorded as t1.

Figure 12:
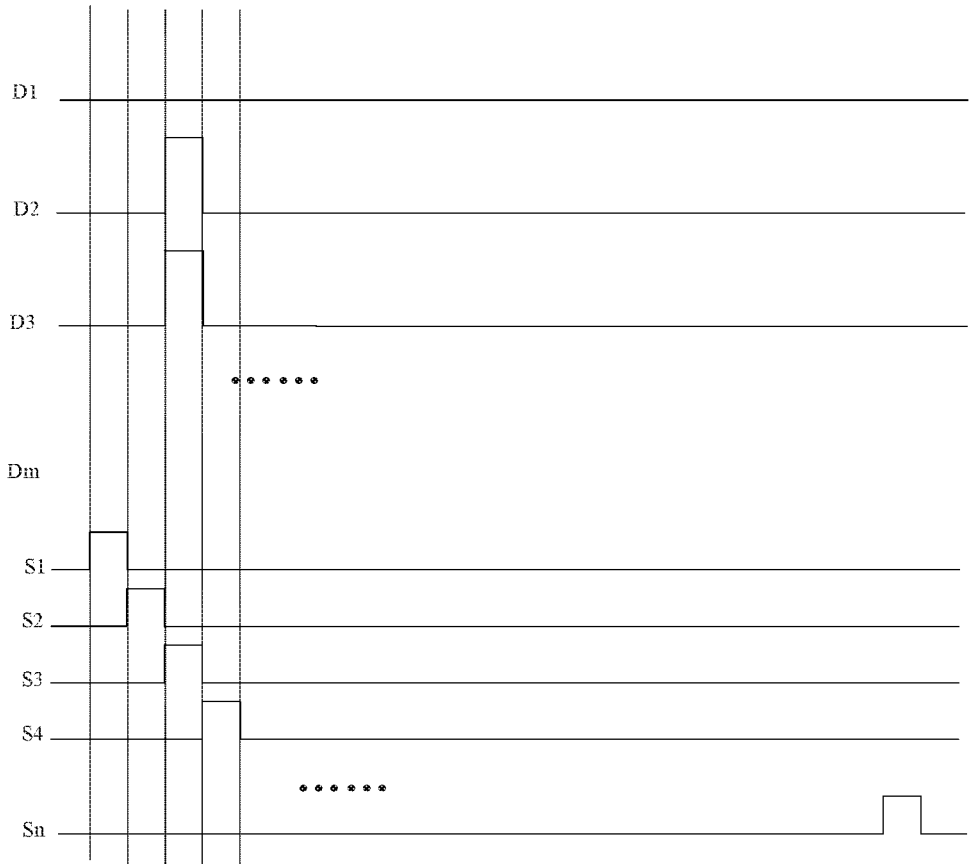
FIG. 12 shows a timing chart of a control signal of a gray scale voltage corresponding to L1 display at the time of the 255th progressive scanning of the scan line.

FIG. 12 shows a timing chart of a control signal of a gray scale voltage corresponding to L1 display at the time of the 255th progressive scanning of the scan line. As shown in FIG. 12, when the scan line is progressively scanning for the 255th time, the row control signal output by S is at a high level, no pixel point of the L1 gray scale is required to display at the first row in gray scale of the to-be-displayed image shown in FIG. 9, therefore, the column control signals output by the corresponding data lines D1, D2 and D3 are all low levels; similarly, the row control signals output by the S2 and S4 are at high levels, no pixel point of the L1 gray scale is required to display at the second row and the fourth row in gray scale of the to-be-displayed image shown in FIG. 9, therefore, the column control signals output by the corresponding data lines D1, D2 and D3 are all low levels; only the row control signal output by the S3 is at a high level, two pixel points of the L1 gray scale are required to display at the third row in gray scale of the to-be-displayed image shown in FIG. 9, that is, (3, 2) and (3, 3) pixel points, therefore, the column control signals output by the corresponding data lines D2 and D3 are valid high levels.

For display L0 gray scale pixel points, after the pixel electrodes of all the pixel points that are required to display the L1 gray scale in the display panel are charged to the Von voltage, Tcon waits for time tw. Then the row control signal starts the next scan and are progressively scanning from the first row to the last row, at which time the data line D is kept at a low level, so that the pixel electrodes of the pixel points that are required to display the L0 gray scale are not charged. Or after the pixel electrodes of all the pixel points that are required to display the L1 gray scale in the display panel are charged to Von and the Tcon wait time tw+tt, the display of L0 is completed (tt is the time required for the row control signal to scan from the first row to the last row).

Figure 13:
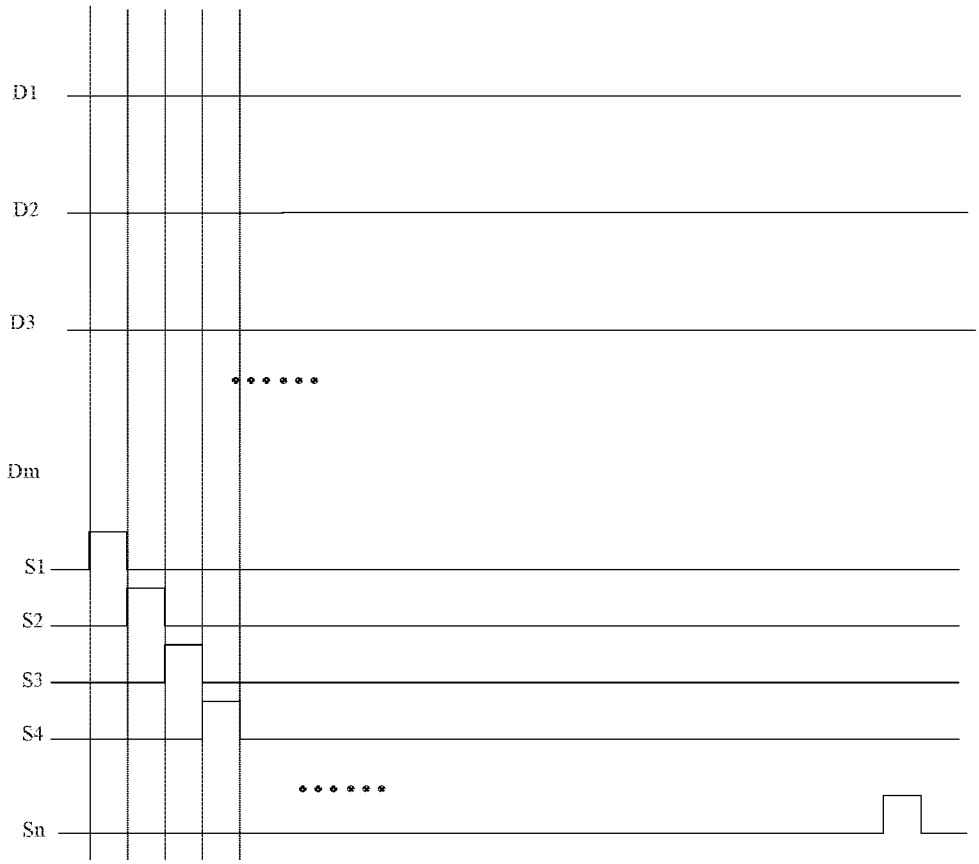
FIG. 13 shows a timing chart of a control signal of a gray scale voltage corresponding to L0 display at the time of the 256th progressive scanning of the scan line.

FIG. 13 shows a timing chart of a control signal of a gray scale voltage corresponding to L0 display at the time of the 256th progressive scanning of the scan line. As shown in FIG. 13, when the scan line is progressively scanning for the 256th time, the row control signals output by S, S2, and S3 are at high levels, no pixel point of the L0 gray scale is required to display from the first row to the third row in gray scale of the to-be-displayed image shown in FIG. 9, and the pixel point of the L0 gray scale is required to display only at the fourth row, and since the gray scale is L0, the column control signals output by the corresponding data lines D1, D2, and D3 are always low levels.

After all the gray scale display is completed, all T4 and T5 are turned on by pulling Voff high after waiting for tw, and all pixel electrode voltages are discharged to Vcom, and the next frame display starts.

The next frame begins to repeat the action of the previous frame.

The above ADS is to apply a gray scale voltage signal to the pixel capacitor corresponding to each gray scale level in the gray scale decreasing manner, and distinguishes different gray scale levels by decreasing the duration. The following TN mode is in the normally white mode, and to apply a gray scale voltage signal to the pixel capacitor corresponding to each gray scale level in the gray scale increasing manner, and also distinguishes the different gray-scale levels by decreasing the duration.

In the TN display mode, at the beginning of the first frame, Voff is set at a low level to turn off T4 and T5, and Von is set to 2Vcom or 0V.

For display L0 gray-scale pixel points, the row control signals are progressively scanning from the first row to the last row, and the time when the row control signal starts scanning is recorded as ts; if the pixel corresponding to the current row is required to display the L0 gray scale, the data line D signal corresponding to the column is set at a high level. At this time, the first transistor T1 and the second transistor T2 are simultaneously turned on, the storage capacitor C1 is charged, the gate of T3 is set at a high level, T3 is turned on, and the liquid crystal capacitor Clc is charged. Due to the presence of the storage capacitor C, the gate voltage of T3 will be gradually increased to T3 to the maximum. All row control signals can continue to scan the next row without waiting for the pixel electrode of the liquid crystal capacitor Clc to be charged to Von, increasing the scan rate. When the row control signal is scanned to the last row, the pixel electrodes of all the pixel points that are required to display the L0 gray scale are charged to the Von voltage, and this moment is recorded as t0.

For display L1 gray scale pixel points, after the pixel electrodes of all the pixel points that are required to display the L0 gray scale in the display panel are charged to the Von voltage, Tcon waits for time tw. Then the row control signal starts the next scan and are progressively scanning from the first row to the last row; if the pixel corresponding to the current row is required to display the L1 gray scale, the data line D signal corresponding to the column is set at a high level. At this time, the first transistor T1 and the second transistor T2 are simultaneously turned on, the storage capacitor C1 is charged, the gate of T3 is set at a high level, T3 is turned on, and the liquid crystal capacitor Clc is charged. Due to the presence of the storage capacitor C1, the gate voltage of T3 will be gradually increased to T3 to the maximum. All row control signals can continue to scan the next row without waiting for the pixel electrode of the liquid crystal capacitor Clc to be charged to Von, increasing the scan rate. When the row control signal is scanned to the last row, the pixel electrodes of all the pixel points that are required to display the L1 gray scale are charged to the Von voltage, and this moment is recorded as t1.

For display L2 gray-scale pixel points: after the pixel electrodes of all the pixel points that are required to display the L1 gray scale in the display panel are charged to the Von voltage, Tcon waits for time tw. Then the row control signal starts the next scan and are progressively scanning from the first row to the last row; if the pixel corresponding to the current row is required to display the 2 gray scale, the data line D signal corresponding to the column is set at a high level. At this time, the first transistor T1 and the second transistor T2 are simultaneously turned on, the storage capacitor C1 is charged, the gate of T3 is set at a high level, T3 is turned on, and the liquid crystal capacitor Clc is charged. Due to the presence of the storage capacitor C1, the gate voltage of T3 will be gradually increased to T3 to the maximum. All row control signals can continue to scan the next row without waiting for the pixel electrode of the liquid crystal capacitor Clc to be charged to Von, increasing the scan rate. When the row control signal is scanned to the last row, the pixel electrodes of all the pixel points that are required to display the L2 gray scale are charged to the Von voltage, and the time is recorded as t2.

By analogy, after the pixel electrodes of all the pixel points that are required to display the L(N−1) (N<255) gray scale in the display panel are charged to the Von voltage, the timing controller Tcon waits for time tw. Then the row control signal starts the next scan, so that the pixel electrodes of all the pixel points that are required to display the L (N) gray scale are charged to the Von voltage.

For display L255 gray scale pixel points, after the pixel electrodes of all the pixel points that are required to display the L254 gray scale in the display panel are charged to the Von voltage, Tcon waits for time tw. Then the row control signal starts the next scan and are progressively scanning from the first row to the last row, at which time the data line D is kept at a low level, so that the pixel electrodes of the pixel points that are required to display the L255 gray scale are not charged. Or after the pixel electrodes of all the pixel points that are required to display the L254 gray scale in the display panel are charged to Von and the Tcon wait time tw+tt, the display of L255 is completed (tt is the time required for the row control signal to scan from the first row to the last row).

After all the gray scale display is completed, all T4 and T5 are turned on by pulling Voff high after waiting for tw, and all pixel electrode voltages are discharged to Vcom, and the next frame display starts.

The next frame begins to repeat the action of the previous frame.

In the TN display mode, the T1 in each gray scale pixel circuit is turned on one by one in the gray scale increasing manner, and the corresponding liquid crystal capacitor the liquid crystal capacitor Clc is charged to the gray-scale voltage for display, and the timing chart of the control signal when each gray scale voltage is displayed can follow the display principle, which is similar to that in the above ADS display mode, and can be seen in FIG. 10 to FIG. 13, and details are not described herein again.

In summary, the pixel circuit and the driving method are provided by the arrangement. The gray scale is charged to the same pixel voltage one by one, and the voltage holding time of the liquid crystal capacitor Clc is controlled to obtain the corresponding gray scale. Regardless of the resolution of the display panel, the charging time is 1/(Refresh rate*the number of gray scale levels) s, effectively increasing the charging time and the charging rate.

In addition, the arrangement can also solve the problem of uneven discharge caused by the progressive starting, and the Vcom electrode is connected with the pixel electrode after shutdown, which can effectively solve the problem of poor startup sparking and drift caused by different discharge speeds of the pixel electrode and the Vcom electrode.

Other arrangements of the present disclosure will be apparent to those skilled in the art. The present application is intended to cover any variations, uses, or adaptations of the present disclosure, which are in accordance with the general principles of the present disclosure and include common general knowledge or conventional technical means in the art that are not disclosed in the present disclosure. The specification and arrangements are illustrative, and the real scope and spirit of the present disclosure is defined by the appended claims.

What is claimed is:

1. A pixel circuit, comprising:

a liquid crystal capacitor having a first end and a second end;

a selection unit having a first end, a second end, and an output end, wherein the first end of the selection unit is configured to receive a column control signal, the second end of the selection unit is configured to receive a row control signal, and the selection unit is configured to determine whether to charge the liquid crystal capacitor according to the row control signal and the column control signal;

a gray scale writing unit having a first end, a second end, and an output end, wherein the first end of the gray scale writing unit is connected to the output end of the selection unit, and the second end of the gray scale writing unit is connected to a gray scale voltage signal, the output end of the gray scale writing unit is connected to the second end of the liquid crystal capacitor, and the gray scale writing unit is configured to, when the selection unit determines to charge the liquid crystal capacitor, apply the gray scale voltage signal to the liquid crystal capacitor, and a gray scale level displayed by the liquid crystal capacitor is controlled by an application duration of the gray scale voltage signal; and a reset unit having a first end, a second end, a third end, and a fourth end, wherein the first end of the reset unit is connected to a reset signal end, the second end of the reset unit is connected to the output end of the selection unit, and the third end of the reset unit is connected to the output end of the gray scale writing unit, the fourth end of the reset unit is connected to a common voltage signal, and the reset unit is configured to disconnect the gray scale writing unit and the liquid crystal capacitor to stop charging the liquid crystal capacitor upon receiving the reset signal end, and reset voltage of the liquid crystal capacitor to an initial state.

2. The pixel circuit according to claim 1, the selection unit comprises:

a first transistor having a first end, a second end and a control end, a second transistor each having a first end, a second end and a control end, wherein the control end of the first transistor is connected to the column control signal, and the first end of the first transistor is connected to the row control signal, the second end of the first transistor is connected to the first end of the second transistor, and the control end of the second transistor is connected to the row control signal.

3. The pixel circuit according to claim 2, wherein the gray scale writing unit comprises a third transistor having a first end, a second end and the control end, wherein the control end of the third transistor is connected to the second end of the second transistor, the first end of the third transistor is connected to the gray scale voltage signal, and the second end of the third transistor is connected to the second end of the liquid crystal capacitor.

4. The pixel circuit according to claim 3, the reset unit comprises:

a fourth transistor, a fifth transistor, and a storage capacitor, wherein each of the fourth transistor and the fifth transistor has the first end, the second end and the control end, the storage capacitor has the first end and the second end, the control ends of the fourth transistor and the fifth transistor are both connected to the reset signal end, and the first ends of the fourth transistor, the fifth transistor and the storage capacitor are all connected to the second end of the second transistor, the second end of the fourth transistor is connected to the common voltage signal, and the second end of the fifth transistor and the storage capacitor is connected to the first end of the liquid crystal capacitor, and the second end of the liquid crystal capacitor is connected to the common voltage signal.

5. A display device, comprising:

a display panel having a plurality of pixel circuits according to claim 1 arranged in an array;

a timing controller configured to determine the gray scale level to display in each of the plurality of the pixel circuits in the display panel according to information of a to-be-displayed image, and cause a liquid crystal capacitor in each of the plurality of the pixel circuits to display the gray scale level by controlling a charging duration of the liquid crystal capacitor in each of the plurality of pixel circuits.

6. The display device according to claim 5, the timing controller comprises:

a gray scale control unit configured to sequentially apply a plurality of gray scale voltage signals to the liquid crystal capacitors in the plurality of pixel circuits according to the gray scale level; and a charging control unit configured to simultaneously stop applying the plurality of gray scale voltage signals to the liquid crystal capacitors in the plurality of pixel circuits in the display panel to control the charging duration of the liquid crystal capacitor in each of the plurality of pixel circuits.

7. The display device according to claim 6, wherein the gray scale control unit is configured to:

determine location information of the charging duration pixel circuits corresponding to a first gray scale level in the display panel;

generate corresponding row control signals and column control signals according to the location information;

apply the plurality of gray scale voltage signals to the liquid crystal capacitors in the plurality of pixel circuits corresponding to the first gray scale level row by row according to the row control signals and the column control signals; and apply the plurality of gray scale voltage signals to the liquid crystal capacitors in the plurality of pixel circuits corresponding to a second gray scale level after applying the gray scale voltage signals to all the liquid crystal capacitors corresponding to the first gray scale levels, until the gray scale voltage signals are applied to the liquid crystal capacitors in all the pixel circuits corresponding to a first level of a last gray scale level.

8. A driving method for a pixel circuit, the pixel circuit comprising:

a liquid crystal capacitor having a first end and a second end;

a selection unit having a first end, a second end, and an output end, wherein the first end of the selection unit is configured to receive a column control signal, the second end of the selection unit is configured to receive a row control signal, and the selection unit is configured to determine whether to charge the liquid crystal capacitor according to the row control signal and the column control signal;

a gray scale writing unit having a first end, a second end, and an output end, wherein the first end of the gray scale writing unit is connected to the output end of the selection unit, and the second end of the gray scale writing unit is connected to a gray scale voltage signal, the output end of the gray scale writing unit is connected to the second end of the liquid crystal capacitor, and the gray scale writing unit is configured to, when the selection unit determines to charge the liquid crystal capacitor, apply the gray scale voltage signal to the liquid crystal capacitor, and a gray scale level displayed by the liquid crystal capacitor is controlled by an application duration of the gray scale voltage signal control; and a reset unit having a first end, a second end, a third end, and a fourth end, wherein the first end of the reset unit is connected to a reset signal end, the second end of the reset unit is connected to the output end of the selection unit, and the third end of the reset unit is connected to the output end of the gray scale writing unit, the fourth end of the reset unit is connected to a common voltage signal, and the reset unit is configured to disconnect the gray scale writing unit and the liquid crystal capacitor to stop charging the liquid crystal capacitor upon receiving the reset signal end, and reset voltage of the liquid crystal capacitor to an initial state, wherein the driving method comprises:

determining whether to charge the liquid crystal capacitor according to the row control signal and the column control signal; and applying the gray scale voltage signal to the liquid crystal capacitor when determining to charge the liquid crystal capacitor;

wherein the gray scale level of the liquid crystal capacitor is determined by the application duration of the gray scale voltage signal.

9. The driving method for a pixel circuit according to claim 8, further comprising: stopping charging the liquid crystal capacitor and resetting a voltage of the liquid crystal capacitor to an initial state upon receiving a reset signal.

10. A driving method for a display device, the display device comprising:

a display panel having a plurality of pixel circuits according to claim 1 arranged in an array;

a timing controller configured to determine a gray scale level to display in each of the plurality of pixel circuits in the display panel according to information of a to-be-displayed image, and make a liquid crystal capacitor of each of the plurality of pixel circuits display a corresponding gray scale level by controlling a charging duration of the liquid crystal capacitor in each of the pixel circuits pixel circuits;

wherein, the driving method comprises:

determining the gray scale level;

determining location information of the plurality of pixel circuits corresponding to a first gray scale level in the display panel;

generating corresponding row control signals and column control signals according to the location information;

applying the gray scale voltage signals to the liquid crystal capacitors in the plurality of pixel circuits corresponding to the first gray scale level row by row according to the row control signals and the column control signals; and applying the gray scale voltage signals to the liquid crystal capacitors in the plurality of pixel circuits corresponding to a second gray scale level after applying the gray scale voltage signal to all the liquid crystal capacitors corresponding to the first gray scale level, until the gray scale voltage signal is applied to the liquid crystal capacitors in the plurality of pixel circuits corresponding to a first level of a last level gray scale level;

sequentially applying a gray scale voltage signal to the respective liquid crystal capacitors in all the pixel circuits according to the gray scale levels; and stopping simultaneously applying the gray scale voltage signal to the liquid crystal capacitors in the plurality of pixel circuits in the display panel to control the charging duration of the liquid crystal capacitors in each of the plurality of pixel circuits;

wherein time of displaying a frame in the display panel is 1/(refresh rate*number of gray scale levels), wherein the number of gray scale levels is the number of all gray scale levels of the image, and the refresh rate is the number of times the display panel is refreshed in one second.

11. The driving method for the display device according to claim 10, wherein determining the gray scale level comprises:

determining the grays scale level that each of the plurality of pixel circuits in the display panel is required to display according to information of a to-be-displayed image.

12. The display device according to claim 5, the selection unit comprises:

a first transistor having a first end, a second end and a control end, a second transistor each having a first end, a second end and a control end, wherein the control end of the first transistor is connected to the column control signal, and the first end of the first transistor is connected to the row control signal, the second end of the first transistor is connected to the first end of the second transistor, and the control end of the second transistor is connected to the row control signal.

13. The display device according to claim 6, the selection unit comprises:

a first transistor having a first end, a second end and a control end, a second transistor each having a first end, a second end and a control end, wherein the control end of the first transistor is connected to the column control signal, and the first end of the first transistor is connected to the row control signal, the second end of the first transistor is connected to the first end of the second transistor, and the control end of the second transistor is connected to the row control signal.

14. The display device according to claim 7, the selection unit comprises:

a first transistor having a first end, a second end and a control end, a second transistor each having a first end, a second end and a control end, wherein the control end of the first transistor is connected to the column control signal, and the first end of the first transistor is connected to the row control signal, the second end of the first transistor is connected to the first end of the second transistor, and the control end of the second transistor is connected to the row control signal.

15. The display device according to claim 13, wherein the gray scale writing unit comprises a third transistor having a first end, a second end and the control end, wherein the control end of the third transistor is connected to the second end of the second transistor, the first end of the third transistor is connected to the gray scale voltage signal, and the second end of the third transistor is connected to the second end of the liquid crystal capacitor.

16. The display device according to claim 15, the reset unit comprises:

a fourth transistor, a fifth transistor, and a storage capacitor, wherein each of the fourth transistor and the fifth transistor has the first end, the second end and the control end, the storage capacitor has the first end and the second end, the control ends of the fourth transistor and the fifth transistor are both connected to the reset signal end, and the first ends of the fourth transistor, the fifth transistor and the storage capacitor are all connected to the second end of the second transistor, the second end of the fourth transistor is connected to the common voltage signal, and the second end of the fifth transistor and the storage capacitor is connected to the first end of the liquid crystal capacitor, and the second end of the liquid crystal capacitor is connected to the common voltage signal.

17. The driving method for a pixel circuit according to claim 8, wherein the selection unit comprises:

a first transistor having a first end, a second end and a control end, a second transistor each having a first end, a second end and a control end, wherein the control end of the first transistor is connected to the column control signal, and the first end of the first transistor is connected to the row control signal, the second end of the first transistor is connected to the first end of the second transistor, and the control end of the second transistor is connected to the row control signal.

* * * * *